United States Patent [19]

Mimura

[11] 4,444,859

[45] Apr. 24, 1984

[54] ELECTROPHOTOGRAPHIC PROCESS AND PHOTOSENSITIVE MEMBER FOR USE IN SAID PROCESS

[75] Inventor: Yoshiyuki Mimura, Hachioji, Japan

[73] Assignee: Olympus Optical Company Limited, Tokyo, Japan

[21] Appl. No.: 382,609

[22] Filed: May 27, 1982

[30] Foreign Application Priority Data

May 30, 1981 [JP] Japan ..... 56-81848
May 30, 1981 [JP] Japan ..... 56-81849

[51] Int. Cl.[3] ..... G03G 13/22; G03G 13/24
[52] U.S. Cl. ..... 430/54; 430/55
[58] Field of Search ..... 430/55, 54

[56] References Cited

U.S. PATENT DOCUMENTS

| | | | |
|---|---|---|---|
| 3,457,070 | 7/1969 | Watanabe et al. | 430/55 X |
| 3,655,369 | 4/1972 | Kinoshita | 430/51 |
| 3,813,243 | 5/1974 | Kitajima et al. | 430/55 X |
| 4,071,361 | 1/1978 | Marushima | 430/55 X |
| 4,254,199 | 3/1981 | Tutihasi | 430/55 X |

FOREIGN PATENT DOCUMENTS

| | | | |
|---|---|---|---|
| 934434 | 9/1973 | Canada | 430/55 |

*Primary Examiner*—Roland E. Martin, Jr.
*Attorney, Agent, or Firm*—Fleit, Jacobson, Cohn & Price

[57] ABSTRACT

An electrophotographic process for forming an electrostatic latent image in a photosensitive member. The photosensitive member is formed by applying, on a transparent conductive substrate, a transparent insulating layer and a photoconductive layer, which photoconductive layer is composed of a charge transfer layer and charge generation layers applied on both surfaces of the charge transfer layer. The charge transfer layer has a high mobility for charges of positive polarity. At first, the photosensitive member is negatively charged, while the member is uniformly irradiated from the side of the substrate. Then the photosensitive member is positively charged, while the member is exposed to a positive image of a document from the side of the photoconductive layer. Finally, the photosensitive member is exposed to a negative image of the document from the side of the photoconductive layer to form the electrostatic latent image from charges trapped across the insulating layer.

24 Claims, 34 Drawing Figures

ELECTROPHOTOGRAPHIC PROCESS AND PHOTOSENSITIVE MEMBER FOR USE IN SAID PROCESS

BACKGROUND OF THE INVENTION

The present invention relates to an electrophotographic process, and more particularly to a retention type electrophotographic process for forming a plurality of copies of a document from the same and single electrostatic charge image once formed on an electrophotographic photosensitive member.

There have been proposed various processes for forming a plurality of copies of a document. In one known process, a number of copies are duplicated from the same and single electrostatic charge image which has been once formed on a photosensitive drum, by repeatedly effecting development with toner and transfer of a toned image onto successive image receiving papers. Usually such a process is referred to as a retention-type electrophotographic process. In such a process, in order to obtain a number of copies having good image quality, it is necessary to maintain the charge image, once formed on the photosensitive drum, in stable form for a long time period. In known processes, since the latent image is composed of the electrostatic charge applied on an upper surface of the photosensitive member, the latent image might decay or deteriorate due to undesired escape of electrostatic charge through the developing agent and undesired injection of electrostatic charge via the image receiving papers from a biased transfer device. Therefore, the electrostatic charge image could not be retained in stable form on the photosensitive member during the duplication of a plurality of copies, and thus it is difficult to obtain a duplicated image of good quality over a number of copies of the same document.

In order to avoid such a drawback, it is known, from Japanese Patent Application Laid-open Publication No. 72,053/76, to use an electrophotographic photosensitive member 1 comprising an electrically conductive substrate 2, a charge retentive layer 3 made of insulating material and applied on the substrate, and a photoconductive layer 4 applied on the charge retentive layer as illustrated in FIG. 1. At first, a primary electrification of one polarity is effected by means of a corona charger 5 and at the same time the member 1 is irradiated uniformly as shown in FIG. 1A. This irradiation may be effected after the primary electrification. During this step, the charges are trapped across the charge retentive layer 3. Then, as illustrated in FIG. 1B, a secondary electrification of an opposite polarity is effected by means of a corona charger 6, while an image of a document to be duplicated is projected upon the photosensitive member 1. Then in an imagewise bright portion L, the charges are trapped across the charge retentive layer 3, while in an imagewise dark portion D the charges are trapped across the photoconductive layer 4. Next, a uniform exposure is carried out to remove the charges trapped across the photoconductive layer 4 to form an electrostatic charge image as shown in FIG. 1C. This latent image is formed by only the charges trapped across the insulating charge retentive layer 3 and thus is little affected by the development and transfer, so that a number of copies can be formed from the same and single latent image. However, in this known process, there is a drawback in that the resolution of the latent image might be affected by the amount of light used during the uniform exposing step. That is to say, when the light amount is small, the electrostatic contrast becomes smaller although the resolution is increased, whereas when the light amount is large, the resolution becomes smaller although the contrast is improved. Due to the decrease in the resolution, the edge of the image is liable to become obscure. The obscurity at the image edge is assumed to be introduced by the following mechanism. In the secondary electrification together with the imagewise projection shown in FIG. 1B, a positive charge exists on the free surface of the photoconductive layer 4 and a negative charge is trapped in an interface between the photoconductive layer 4 and charge retentive layer 3. In the imagewise bright area L, these positive and negative carriers are cancelled out by means of carrier pairs generated in the photoconductive layer 4 due to the uniform exposure in FIG. 1C. During this process, as shown in FIG. 2, the carrier pairs 7 produced at the image edge are polarized and held along an irregular electric field 8. Therefore, in the bright portion L, the charge trapped in the interface between the charge retentive layer 3 and photoconductive layer 4 is uniformly spread toward the dark portion D. Further, the known photosensitive member 1 has a relatively thick photoconductive layer 4 and thus, the light image of the document is liable to become obscure.

The known electrophotographic process illustrated in FIG. 1 has another drawback in that the contrast of the latent image is greatly influenced by the characteristics of the photoconductive layer 4. That is to say, when it is assumed that the photoconductive layer 4 is of the P-type and the primary electrification is effected in the negative polarity, positive photo-carriers among photo-carrier pairs generated in the photoconductive layer 4 in the uniform exposure step shown in FIG. 1A are neutralized by negative charges on the surface of layer 4, and negative photo-carriers are attracted by the positive carriers which have been induced in the conductive substrate 2 and arrive at the charge retentive layer 3. However, since the photoconductive layer 4 is of the P-type, the mobility of the negative carriers in the photoconductive layer is small, and thus the negative carriers are liable to be trapped in the photoconductive layer 4 to generate a spacial charge. Therefore, the number of charge pairs retained across the charge retentive layer 3 becomes smaller and the contrast of the latent image becomes lower. In order to avoid such a disadvantage, it sould be noted that the resistance of the photoconductive layer 4 can be reduced by effecting the uniform exposure excessively. However, then the concentration of free carriers will be increased, and thus the image quality might be affected during the processes after the simultaneous secondary charging and imagewise exposing step. Further, the lamp for effecting the uniform exposure will consume a greater amount of electric power.

In the case of using a photoconductive layer 4 made of n-type material and effecting primary charge in the negative polarity, during the simultaneously or successively effected primary charging and uniform exposing step, positive photo-carriers among photo-carrier pairs generated in the photoconductive layer 4 are neutralized by negative charges on the surface of photoconductive layer 4, and negative photo-carriers are easily transported in the layer 4 to arrive at the charge retentive layer 3. Therefore, during this process no problems arise. However, in the next step of effecting simultaneously the secondary charging and imagewise exposing shown in FIG. 1B, since positive photo-carriers among photo-carrier pairs generated in the photoconductive layer 4 could not move easily in the n-type photoconductive layer 4, the contrast between the imagewise bright and dark portions might be decreased. This phenomenon will be further enhanced by the fact that during the uniform exposing step illustrated in FIG. 1C, positive photo-carriers among photo-carrier pairs generated in the photoconductive layer 4 in the imagewise dark portion D could not easily move in the photoconductive layer 4.

In the known electrophotographic process shown in FIG. 1, the electrostatic latent image is erased by effecting an A.C. corona charge or making the photoconductive layer 4 into contact with a conductive brush, while the photosensitive member is uniformly irradiated. During this step, if the photoconductive layer 4 has a particular polarity, it is impossible, or at least difficult to erase the latent image completely and residual charges might decrease the resolution of the next electrostatic latent image to be formed.

In order to avoid the above-mentioned various drawbacks, the photoconductive layer 4 may be formed by material having both P and n-type characteristics. However, photoconductive material having both polarity characteristics is not usually found. Moreover, it is quite difficult to treat such photoconductive material so as to control donor and acceptor concentrations to be balanced properly.

SUMMARY OF THE INVENTION

The present invention has for its object to provide a novel and useful electrophotographic process which can avoid the various drawbacks of the known processes and can form an electrostatic latent image having higher contrast and resolution.

It is another object of the invention to provide an electrophotographic process which can form an electrostatic latent image in a prompt manner with a minimum amount of irradiation and thus has a higher duplication speed.

It is still another object of the invention to provide an electrophotographic process in which an electrostatic latent image can be retained stably for a long time period and thus is particularly suitable for forming a number of copies from the same latent image.

It is still another object of the invention to provide an electrophotographic process in which an electrostatic latent image can be erased efficiently within a short time.

According to the invention, an electrophotographic process is provided for forming at least one copy of a document by means of an electrophotographic photosensitive member which comprises a transparent conductive substrate, a transparent insulating layer and a photoconductive layer having a charge generation function at least in both surface regions of the photoconductive layer, and having a charge transfer function for carriers of a given polarity, the insulating layer and photoconductive layer being applied on the substrate. The process comprises:

(a) the step of effecting a primary charging of one polarity and a light exposure;

(b) the step of effecting simultaneously a secondary charging of the other polarity and an image exposure; and (c) the step of effecting light exposure for at least an image dark portion in said imagewise exposure step (b); whereby each of said exposures in the steps (a), (b) and (c) is effected from such a side of the photoconductive layer that photo-carriers of said given polarity among photo-carrier pairs generated in the surface region of photoconductive layer are moved effectively through the bulk of the photoconductive layer so as to form an electrostatic latent image by charges trapped across the transparent insulating layer.

In embodiments of the electrophotographic process according to the invention, said light exposure in step (a) is effected by uniformly irradiating the photosensitive member or by projecting a positive image of the document from either side of the photosensitive member. Further, the light exposure in step (c) is carried out by uniformly irradiating the photosensitive member or by projecting a negative image of the document.

The present invention also relates to an electrophotographic photosensitive member and has as an object to provide an improved electrophotographic photosensitive member for use in the above-mentioned electrophotographic process according to the invention.

It is another object of the invention to provide an electrophotographic photosensitive member which can be formed by generally available photoconductive material which shows excellent photoconductivity for a particular polarity.

An electrophotographic photosensitive member for use in an electrophotographic process according to the invention comprises a transparent conductive substrate;

a transparent insulating layer; and a photoconductive layer which has a charge generation function at least in both surface regions and has a charge transfer function for transmitting charges of a given polarity; whereby said transparent insulating layer and photoconductive layer are applied on said transparent conductive substrate so as to illuminate the photoconductive layer from either sides thereof.

In the photosensitive member according to the invention, said insulating layer and photoconductive layer may be applied on the substrate in that order or in the opposite order. Further, the charge generation regions may be formed by applying a charge generation layer on both surfaces of a charge transfer layer.

DESCRIPTION OF THE PREFERRED EMBODIMENTS

Figure 1A:
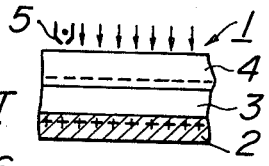
FIG.1A PRIOR ART
FIGS. 1A to 1C are cross sections showing successive steps of a known electrophotographic process.
Figure 1B:
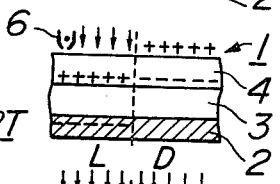
FIG.1B PRIOR ART
Figure 1C:
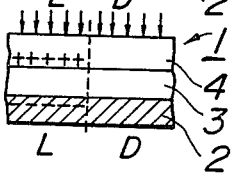
FIG.1C PRIOR ART
Figure 2:
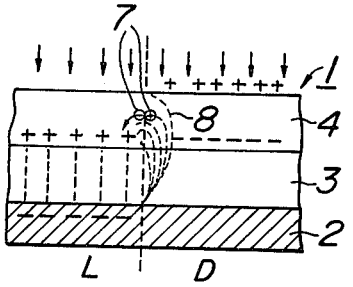
FIG.2 PRIOR ART
FIG. 2 is a cross section for explaining how to spread a latent image in the known process.
Figure 3:
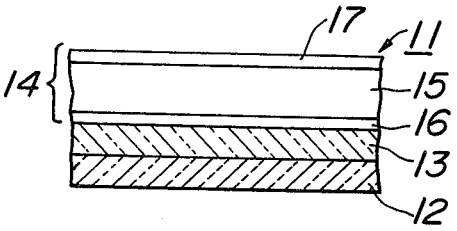
FIGS. 3 to 7 are cross sections illustrating several embodiments of the photosensitive member according to the invention.

FIG. 3 is a cross section showing an embodiment of an electrophotographic photosensitive member according to the invention. The photosensitive member 11 comprises a transparent conductive substrate 12, a transparent insulating layer 13 applied on the substrate, and a photoconductive layer 14 applied on the insulating layer. In this embodiment, the insulating layer 13 serves as a charge retentive layer across which an electrostatic latent image is formed. The photoconductive layer 14 comprises a charge transfer layer 15 and first and second charge generation layers 16 and 17 applied on respective surfaces of the charge transfer layer 15. According to the invention, the charge transfer layer 15 has the property that charges of a given polarity can move easily through the bulk of photoconductive layer 14.

The transparent conductive substrate 12 is made of material which can efficiently transmit light to be made incident upon the first charge generation layer 16. The transparent conductive substrate 12 may be manufactured in various manners. For instance, a metal layer such as gold, palladium and aluminum is applied on the surface of a glass or high polymer base, and then the metal layer is partially etched away to change the conductive film into a network configuration. Alternatively, the transparent conductive substrate 12 may be formed by sandwiching a dielectric film, such as $TiO_2$, having a high refractive index with thin films of highly conductive metal such as gold and silver. Further, the transparent conductive substrate 12 may be made of a conductive or semiconductive thin film such as $In_2O_3$, $SnO_2$, $In_2O_3/SnO_2$, $Cd_2SnO_4$, CuI, $TiO_2$, gold and palladium. It is a matter of course that when using a substrate made of thin films as described in the alternative embodiments, the substrate must be provided on a transparent glass or plastic base.

The transparent insulating layer 13 has to retain thereacross the latent image and has to efficiently transmit the light introduced from the side of the transparent conductive substrate 12. To this end, it is preferable to make the layer 13 of insulating material having a volume resistivity higher than about $10^{12}$ Ω.cm and a transmissivity higher than about 70 percent. For instance, the insulating layer 13 may be made of polyester resin, polyparaxylylene, polycarbonate resin, urethane resin, vinyl chloride-vinyl acetate copolymer, epoxy resin and acrylic resin. The thickness of the insulating layer 13 may be determined based on the material used and the photoconductive layer 14 applied thereon and is preferably set to about 3 to 25μ.

As explained above, photoconductive layer 14 comprises the charge transfer layer 15 and the charge generation layers 16 and 17 applied on respective surfaces of the layer 15. This photoconductive layer 14 of a three layer construction, i.e., charge generation layer 16/charge transfer layer 15/charge generation layer 17, may be manufactured by the following combinations.

(1) Se-Te/Se/Se-Te
(2) Se-Te/polyvinylcarbazole (PVK)/Se-Te
(3) Se-Te-As/Se/Se-Te-As
(4) indigo/2,5-bis(4-diethylaminophenyl)-oxadiazole-1,3,4/indigo
(5) chlorodianeblue/pyrazoline/chlorodianeblue
(6) squarylium/pyrazoline/squarylium
(7) N,N'-dimethylperylimid/3-(N-methyl-N-phenylhydrazone)methyl-9-ethylcarbazole/N,N'-dimethylperylimid
(8) phthalocyanine/PVK/phthalocyanine
(9) CdS:Cu,Cl/ZnS/CdS:Cu,Cl
(10) a-Si/ZnS/a-Si (a-Si means amorphous silicon)

The thickness of the charge generation layers 16 and 17 is preferably set to about 0.1 to 3μ. If the thickness is larger than 3μ, the layer does not contribute to light absorption and the resolution of the latent image might be decreased due to the increase of a dielectric constant of the whole photoconductive layer 14. The charge transfer layer 15 must be such that carriers can be easily or effectively transmitted through interfaces between the charge transfer layer 15 and the charge generation layers 16 and 17, and the mobility of carriers of a particular polarity, i.e., positive or negative carriers, is large, and thus they can easily move through the bulk of the charge transfer layer. Further, in view of the fact that the contrast of the charge image is influenced by the capacitance division between charge transfer layer 15 and insulating layer 13, charge transfer layer 15 preferably has a smaller capacitance and thus, layer 15 is preferably made of material having a smaller dielectric constant and has a thickness of about 5 to 50μ.

Figure 4:
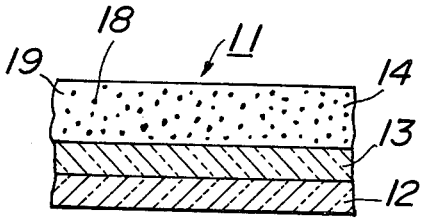
Figure 5:
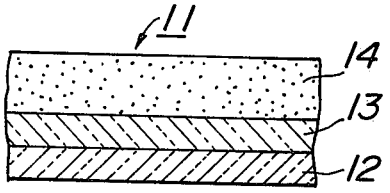

In the embodiment shown in FIG. 3, the photoconductive layer 14 has a three layer construction comprising the charge transfer layer 15 and two charge generation layers 16 and 17 provided on both surfaces of the layer 15. According to the invention, the photoconductive layer 14 is sufficient to comprise a charge generation function in at least both surface regions. FIGS. 4 and 5 illustrate another embodiment of the photosensitive member 11 according to the invention. In the embodiment shown in FIG. 4 a photoconductive layer 14 is formed by a homogeneous single layer which is a mixture of charge generation substances 18 and charge transfer substances 19. For instance, the photoconductive layer 14 may be formed by a mixture of chlorodianeblue and pyrazoline, phthalocyanine and polyvinylcarbazole. Alternatively, the photoconductive layer 14 may be formed as a homogeneous single layer as shown in FIG. 5, in which the layer 14 is formed by dispersing, in a resin, CdS:Cu,Cl or CdS:PbO or by uniformly doping a small amount of Te into Se. This layer 14 has both functions of charge transfer and charge generation.

Figure 6:
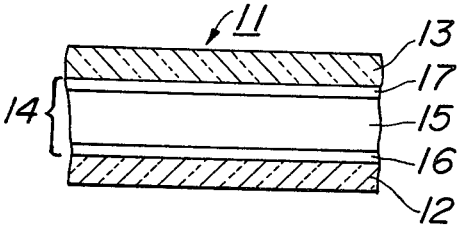
Figure 7:
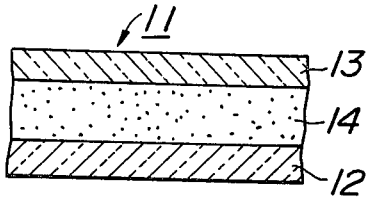

In the embodiments shown in FIGS. 3, 4 and 5, the electrophotographic photosensitive member 11 comprises the transparent conductive substrate 12, the transparent insulating layer 13 applied on the substrate and the photoconductive layer 14 applied on the insulating layer 13. According to the invention, the photoconductive layer 14 may be sandwiched between the transparent substrate 12 and the transparent insulating layer 13. In the embodiment illustrated in FIG. 6, the photoconductive layer 14 consisting of the three layers 15, 16 and 17 is interposed between the transparent substrate 12 and the transparent insulating layer 13. In the embodiment shown in FIG. 7, the homogeneous photoconductive layer 14 illustrated in FIG. 5 is interposed between the transparent substrate 12 and the transparent insulating layer 13.

Now, successive steps of the electrophotographic process according to the invention will be explained with reference to the embodiments.

Figure 8A:
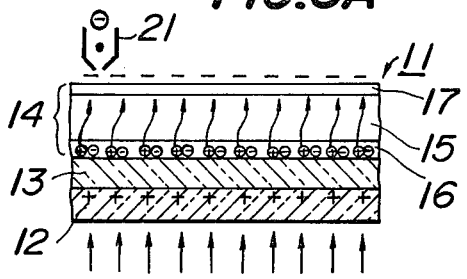
FIGS. 8A to 8H are cross sections depicting successive steps of an embodiment of the electrophotographic process according to the invention.
Figure 8E:
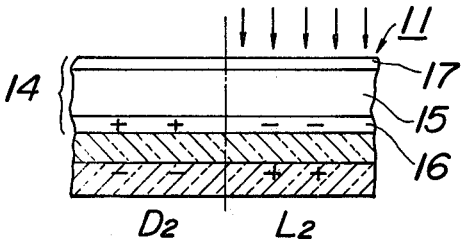
Figure 8B:
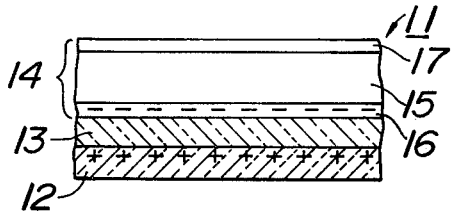

FIGS. 8A to 8H show successive steps of an embodiment of the process according to the invention in which use is made of the photosensitive member 11 illustrated in FIG. 3. FIG. 8A shows primary charging and uniform exposure steps which may be effected simultaneously or successively. Since the photoconductive layer 14 comprises a charge transfer layer 15 of the P-type, the member 11 is charged with negative corona from the side of the photoconductive layer 14 by means of a corona charger 21. A uniform exposure is effected from the side of the transparent substrate 12 in such a manner that only the first charge generation layer 16 is exclusively activated. This may be carried out by projecting light having such an intensity that the light is absorbed by the layers 16 and 15 and thus does not arrive at the second charge generation layer 17. Therefore, photo-carrier pairs are generated in the first charge generation layer 16. Among these positive and negative carriers, positive photo-carriers are effectively transmitted through the P-type charge transfer layer 15 and are neutralized with negative charges electrified on the second charge generation layer 17. Contrary to this, negative photo-carriers remain in the first charge generation layer 16. In this manner, the positive and negative charges are held across the insulating layer 13 as illustrated in FIG. 8B.

Figure 8F:
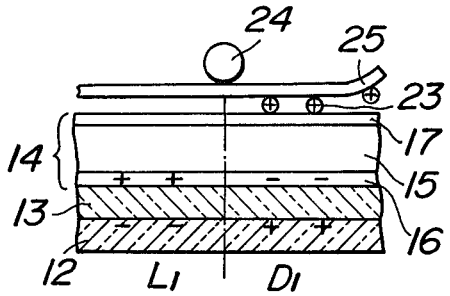
Figure 8C:
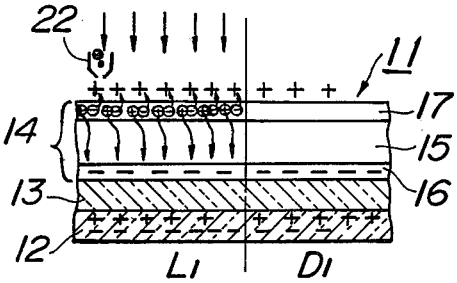
Figure 8G:
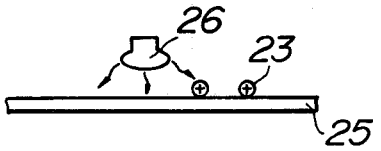
Figure 8D:
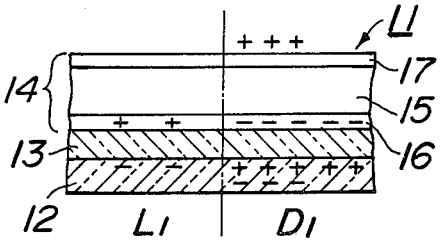

FIG. 8C illustrates the step for effecting simultaneously a secondary charging of opposite polarity to that of the primary charging and a primary imagewise exposure for projecting a positive image onto the member 11 from the side of the photoconductive layer 14. Also in this step, the light intensity is so determined that only the second charge generation layer 17 is selectively activated. It should be noted that throughout the specification, the primary imagewise exposing step means a step for projecting the positive image and a secondary imagewise exposure means a step for projecting a negative image. In an imagewise bright portion $L_1$, positive and negative photo-carriers are generated and positive carriers are transmitted through the P-type charge transfer layer 15 and are neutralized with the negative charges in the first charge generation layer 16, whereas negative charges are neutralized with the positive charges on the second charge generation layer 17. In an imagewise dark portion $D_1$, photo-carriers are not generated and thus, the positive charges on the second charge generation layer 17 remain as they are, and negative charges corresponding in amount to these positive charges are induced in the conductive substrate 12. Therefore, at the end of this step, the photosensitive member 11 retains the charges as illustrated in FIG. 8D.

FIG. 8E shows the secondary imagewise exposing step in which a negative image is projected onto the photo-sensitive member 11 from the side of the photoconductive layer 14. During this step, in the imagewise dark portion $D_2$, since the second charge generation layer 17 is not activated, the charges trapped across the insulating layer 13 remain as they are. In the imagewise bright portion $L_2$, the second charge generation layer 17 is activated and negative photo-carriers are neutralized with the positive charges which have been retained on the surface of the photoconductive layer 14. Positive photo-carriers are moved in the charge transfer layer 15 and are neutralized with a part of the negative charges which have been trapped in the interface between the layers 13 and 16. In this manner, according to the invention, it is possible to form a latent image having a very high contrast and resolution from the charges trapped across the insulating layer 13 and thus, the latent image can be retained in stable form for a long time period.

Figure 8H:
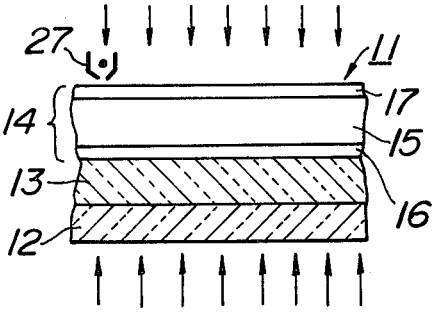

After the latent image has been formed as explained above, the latent image is developed with positively charged toners 23 to form a toner image which is then transferred onto a record paper 25 by means of a transfer roller 24 as illustrated in FIG. 8F. Then the toner image transferred onto the record paper 25 is fixed thereon by means of a heater 26 as shown in FIG. 8G. By repeating the developing, transferring and fixing for the same and single latent image once formed in the photosensitive member 11, it is possible to obtain a plurality of copies. After forming a desired number of copies, the latent image is erased by uniformly exposing the member 11 from both sides and simultaneously effecting an A.C. corona charging from the side of the photoconductive layer 14 by means of an A.C. corona charger 27 as depicted in FIG. 8H. In this manner, the photosensitive member 11 can be prepared for the next duplicating operation. The latent image may be erased by connecting the photoconductive layer 14 to the earth by means of a conductive brush, while the photoconductive layer 14 is irradiated from both sides.

In the above embodiment, the charge transfer layer 15 is made of P-type material and the primary charging is effected in the negative polarity. In a modified embodiment, the primary charging is effected in the positive polarity. Then, the uniform exposure shown in FIG. 8A is effected from the side of the photoconductive layer 14 and the primary and secondary imagewise exposures illustrated in FIGS. 8C and 8E are effected from the side of the transparent substrate 12.

In another modified embodiment, the charge transfer layer 15 is made of N-type material and the primary charging is effected in the negative polarity. Then the uniform exposure shown in FIG. 8A is conducted from the side of the photoconductive layer 14 and the primary and secondary imagewise exposures illustrated in FIGS. 8C and 8E are effected from the side of the transparent substrate 12.

In still another modified embodiment, the charge transfer layer 15 is made of N-type material and the primary charging is effected in the positive polarity. Then, the uniform exposures shown in FIG. 8A take place from the side of the transparent substrate 12, and the imagewise exposures depicted in FIGS. 8C and 8E are carried out from the side of the photoconductive layer 14.

In either of the modified embodiments, an electrostatic charge image having a higher contrast can be formed from charges trapped across the insulating layer 13.

Figure 9A:
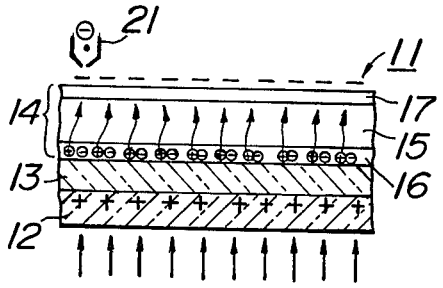
FIGS. 9A to 9H are cross sections showing successive steps of another embodiment of the electrophotographic process according to the invention.
Figure 9E:
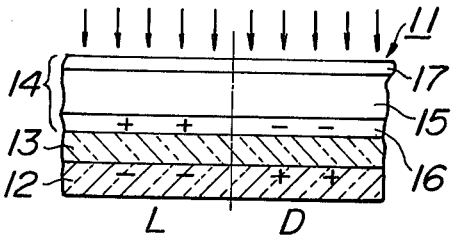
Figure 9B:
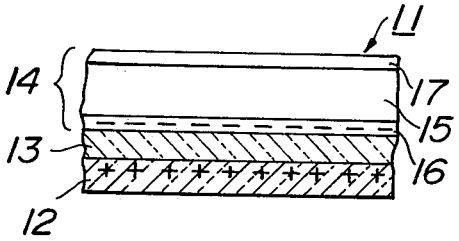
Figure 9F:
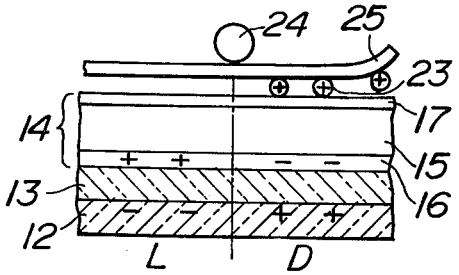
Figure 9C:
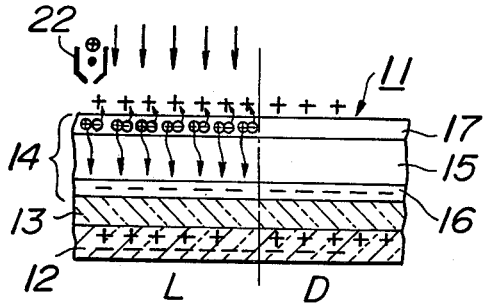
Figure 9G:
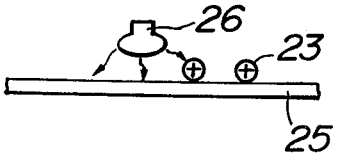
Figure 9D:
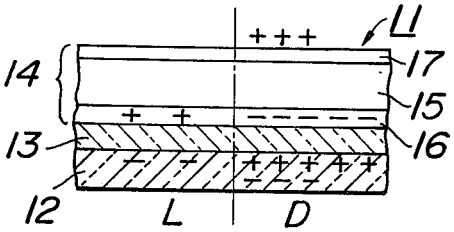
Figure 9H:
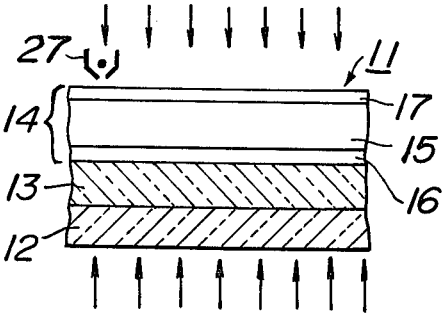

FIGS. 9A to 9H shows successive steps of another embodiment of the electrophotographic process according to the invention. The embodiment is quite similar to that shown in FIGS. 8A to 8H and thus will be explained briefly. The steps shown in FIGS. 9A to 9D are the same as those illustrated in FIGS. 8A to 8D in the previous embodiment. In the present embodiment, after the secondary charging and primary imagewise exposing step shown in FIG. 9C, a uniform exposure is effected from the side of the photoconductive layer 14 as depicted in FIG. 9E. During this step, in the imagewise dark portion D, positive photo-carriers among the photo-carrier pairs generated in the second charge generation layer 17 are transmitted through the charge transfer layer 15 and are neutralized with a part of the negative charges trapped in the interface between the layers 13 and 16, whereas negative photo-carriers are neutralized with the positive charges retained on the second charge generation layer 17. In the imagewise bright portion L, since negative charges could hardly be transmitted through the charge transfer layer 15, the positive charges trapped in the interface between the layers 13 and 16 are retained as they are. In this manner, it is possible to form a latent image having high contrast and resolution from the charges trapped across the insulating layer 13. The developing, transferring, fixing and erasing steps shown in FIGS. 9F, 9G and 9H are the same as those of the previous embodiment.

Now a few numerical examples of the electrophotographic process and photosensitive member for use in the embodiments shown in FIGS. 8A to 8H and 9A to 9H will be explained.

EXAMPLE 1

This example relates to the embodiment illustrated in FIGS. 8A to 8H and use was made of the photosensitive member 11 comprising the transparent conductive substrate 12 formed by a film of polyethylene terephthalate (PET) having a thickness of 25μ and a metal oxide thin layer of $In_2O_3/SnO_2$ applied on the film, the transparent insulating layer 13 made of paraxylylene and having a thickness of 7μ, the first charge generation layer 16 made of Se-Te alloy containing Te by 20% by weight and having a thickness of 0.2μ, the charge transfer layer 15 made of Se and having a thickness of 25μ and the second charge generation layer 17 made of Se-Te alloy containing Te by 10% by weight and having a thickness of 0.2μ. In the primary charging and uniformly exposing step shown in FIG. 8A, a corona charge of −5.5 kv was effected, while the photosensitive member 11 was irradiated with light of 5 lux.sec from the side of the transparent substrate 12. Then in the step illustrated in FIG. 8C, the positive corona charge of 5.7 kv was effected, while the member 11 was irradiated with a positive image in such a manner that in the imagewise bright portion $L_1$, light of about 3 lux.sec and in the imagewise dark portion $D_1$ light lower than about 0.3 lux.sec were projected. Further, in the step of FIG. 8E, the negative image was projected from the side of photoconductive layer 14. The negative image was formed by means of a photochromic film of $SrTiO_3$:Ni-Mo. Then, a latent image having an electrostatic contrast of 520 volts was obtained. The latent image was developed with positively charged toners 23 by means of a magnetic brush developing device to form a toner image which was then transferred onto the record paper 25 by means of the transfer roller 24 to which a transfer bias potential of −700 volts was applied, and then the transferred toner image was fixed onto the record paper 25 by means of the oven-type heater 26 to form a final copy having very high contrast and resolution. By repeating the developing, the transferring and the fixing steps successively a number of copies were obtained from the same and single latent image. The one hundredth copy still had an excellent image quality which was the same as that of the first copy. After forming a number of copies the photosensitive member 11 was uniformly irradiated with light of 10 lux.sec from both sides, while an A.C. corona charge of 5 kv was carried out from the side of the photoconductive layer 14, and then the surface of the photoconductive layer 14 was cleaned by a cleaning brush. After such treatment residual toners and charges were not detected. Then, a new latent image was formed and a number of copies were duplicated. In these latter copies no trace of the previous image was recognized.

EXAMPLE 2

This example is of the embodiment shown in FIGS. 9A to 9H. In this example, the photosensitive member 11 was formed from a film of polyethylene terephthalate (PET) having a thickness of 25μ and a metal oxide thin layer of $In_2O_3/SnO_2$ applied on the film, the transparent insulating layer 13 made of paraxylylene and having a thickness of 5μ, the first charge generation layer 16 made of Se-Te alloy containing Te by 15% by weight and having a thickness of 0.3μ, the charge transfer layer 15 made of Se and having a thickness of 20μ and the second charge generation layer 17 made of Se-Te alloy containing Te by 10% by weight and having a thickness of 0.2μ. In the primary charging and uniformly exposing step shown in FIG. 9A, a corona charge of −5 kv was effected, while the photosensitive member 11 was irradiated with light of 5 lux.sec from the side of the transparent substrate 12. Then in the step illustrated in FIG. 9C, a positive corona charge of 5.5 kv was effected, while the member 11 was irradiated with a positive image in such a manner that in the imagewise bright portion L, light of about 3 lux.sec and in the imagewise dark portion D light lower than about 0.3 lux.sec were projected. Further, in the step of FIG. 9E, a uniform light of 5 lux.sec was projected from the side of the photoconductive layer 14. Then, a latent image having an electrostatic contrast of 500 volts was obtained. The latent image was developed with positively charged toners 23 by means of a magnetic brush developing device to form a toner image which was then transferred onto the record paper 25 by means of the transfer roller 24 to which a transfer bias potential of −700 volts was applied, and then the tranferred toner image was fixed onto the record paper 25 by means of the oven-type heater 26 to form a final copy having very high contrast and resolution. By repeating the developing, transferring and fixing steps, a number of copies were obtained from the single latent image. The one hundredth copy had an excellent image quality which was the same as that of the first copy. After forming a number of copies the photosensitive member 11 was uniformly irradiated with light of 10 lux.sec from both sides, while an A.C. corona charge of 5 kv was carried out from the side of the photoconductive layer 14 and then, the surface of the photoconductive layer 14 was cleaned by a cleaning brush. After such treatment residual toners and charges were not detected. Then, a new latent image was formed and a number of copies were duplicated. In these copies no trace of the previous image was recognized.

EXAMPLE 3

This example 3 is also directed to the embodiment shown in FIGS. 9A to 9H. In this example, the photosensitive member 11 was formed by a transparent conductive substrate 12 consisting of polyethylene terephthalate film of 25μ thickness and a palladium thin layer applied to the film, the transparent insulating film 13 of 6μ thickness made of PET, the first charge generation layer 16 of 1μ thickness made of acrylic resin having copper phthalocyanine dispersed therein, the charge transfer layer 15 of 10μ thickness made of PVK and the second charge generation layer 17 of 1μ thickness made of acrylic resin having copper phthalocyanine dispersed therein. Uniform exposures shown in FIGS. 9A and 9E were carried out under a light intensity of 10 lux.sec and the imagewise exposure illustrated in FIG. 9C was effected with a light intensity of about 10 lux.sec in the imagewise bright portion and of about 0.3 lux.sec in the imagewise dark portion. The remaining conditions were the same as those in Example 2. Then, the electrostatic latent image having an electrostatic contrast of 400 volts was obtained and a large number of copies of good image quality were formed from the single latent image. Further, the latent image was effectively erased and residual toners were removed fully.

Figure 10A:
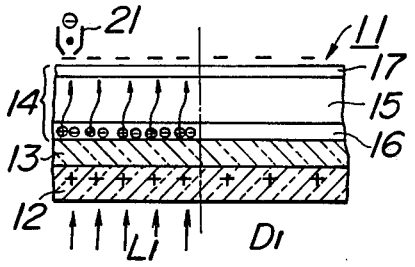
FIGS. 10A to 10H are cross sections showing successive steps of still another embodiment of the electrophotographic process according to the invention.
Figure 10E:
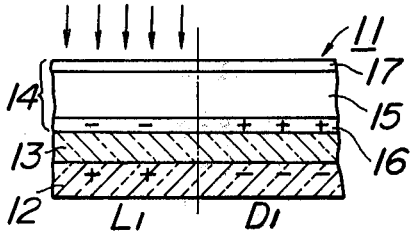
Figure 10B:
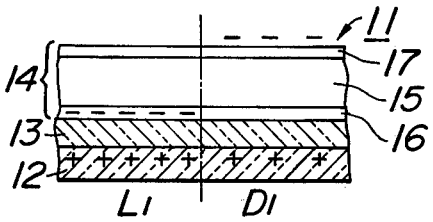

FIGS. 10A to 10H show successive steps of still another embodiment of the electrophotographic process according to the invention in which use is made of the photosensitive member 11 illustrated in FIG. 3. FIG. 10A shows the step of effecting simultaneously primary charging and primary imagewise exposing. Since the photoconductive layer 14 comprises the charge transfer layer 15 of P-type, the member 11 is charged with negative corona from the side of the photoconductive layer 14 by means of a corona charger 21. The imagewise exposure is effected from the side of the transparent substrate 12 in such a manner that only the first charge generation layer 16 is exclusively activated. This may be carried out by projecting a modulated light image having such an intensity that the light is absorbed by the layers 16 and 15 and thus does not arrive at the second charge generation layer 17. Therefore, in an imagewise bright portion $L_1$, photo-carrier pairs are generated in the first charge generation layer 16. Among these positive and negative carriers, positive photo-carriers are effectively transmitted through the P-type charge transfer layer 15 and are neutralized with negative charges electrified on the second charge generation layer 17. Contrary to this, negative photo-carriers remain in the first charge generation layer 16. In an imagewise dark portion $D_1$, since no photo-carrier is generated and the photoconductive layer 14 has a high resistance, the negative charges on the second charge generation layer 17 remain as they are. Therefore, as shown in FIG. 10B, in the imagewise bright portion $L_1$, the charges are retained across the insulating layer 13, whereas in the imagewise dark portion $D_1$, the charges are held between the free surface of second charge generation layer 17 and an interface between the insulating layer 13 and substrate 12. It should be noted that since the primary charging is effected simultaneously with the primary imagewise exposing, the potential in the imagewise bright portion $L_1$ becomes equal to the potential in the imagewise dark portion $D_1$.

Figure 10F:
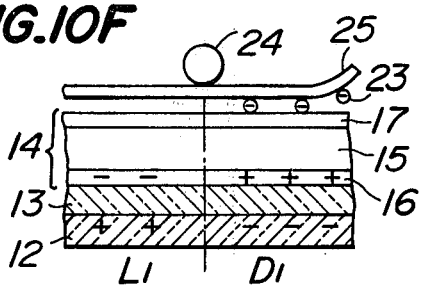
Figure 10C:
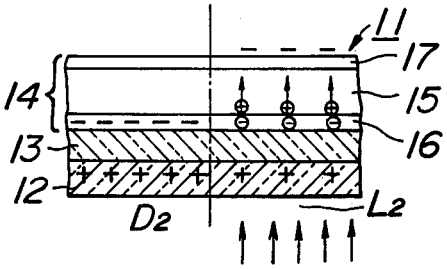

FIG. 10C illustrates the secondary imagewise exposing step for projecting an inverted or negative image onto the member 11 from the side of the substrate 12. Also in this step, the light intensity is so determined that the first charge generation layer 16 is selectively activated. It should be noted that the secondary imagewise exposing step means a step for projecting an inverted or negative image as mentioned before. In an imagewise bright portion $L_2$ which corresponds to the imagewise dark portion $D_1$ in the primary imagewise exposing step, positive and negative photo-carriers are generated and positive carriers are transmitted through the P-type charge transfer layer 15 and are neutralized with the negative charges on the second charge generation layer 17, whereas negative charges remain in the interface between the insulating layer 13 and the first charge generation layer 16. As the result of this step, potentials $V_{L2}$ and $V_{D2}$ in the imagewise bright and dark portions $L_2$ and $D_2$ may be expressed by the following equations.

$$\begin{cases} V_{L2} = \dfrac{C_p}{C_i + C_p} \cdot V_1 \\ V_{D2} = V_1 \end{cases}$$

wherein $V_1$ is the effective potential of the primary charging and $C_i$ and $C_p$ represent electrostatic capacitances of the insulating layer 13 and the photoconductive layer 14, respectively.

Figure 10G:
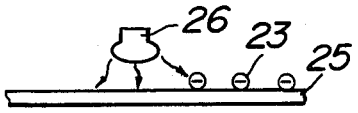
Figure 10D:
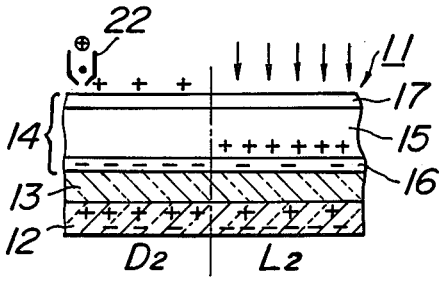

FIG. 10D illustrates the step for effecting simultaneously effecting secondary charging and secondary imagewise exposing. While a positive corona is projected onto the photosensitive member 11 by means of a corona charger 22, a negative image is projected from the side of the photoconductive layer 14 in such a manner that the second charge generation layer 17 is exclusively activated. Then, in the imagewise dark portion $D_2$, since the second charge generation layer 17 is not activated, the negative charges are still retained in the interface between the insulating layer 13 and the photoconductive layer 14 and positive charges remain on the photoconductive layer 14. Thus, negative charges corresponding to the positive charges on the layer 14 are induced in the conductive substrate 12. Contrary to this, in the imagewise bright portion $L_2$, photo-carrier pairs are generated in the second charge generation layer 17 and negative photo-carriers are neutralized with the positive charges on the layer 14, but positive photo-carriers are transmitted through the charge transfer layer 15 and are neutralized with the negative charges which have been trapped in the interface between the insulating layer 13 and the first charge generation layer 16. It should be noted that if the absolute value of the primary charging in the negative polarity is higher than that of the secondary charging in the positive polarity, a residual amount of the negative charges will remain in the interface between the layers 13 and 16.

FIG. 10E shows the primary imagewise exposing step in which the positive image is projected onto the photosensitive member 11 from the side of the photoconductive layer 14. During this step, in the imagewise dark portion $D_1$, since the second charge generation layer 17 is not activated, the charges are trapped across the insulating layer 13. In the imagewise bright portion $L_1$, the second charge generation layer 17 is activated and negative photo-carriers are neutralized with the positive charges which have been retained on the surface of the photoconductive layer 14. Positive photo-carriers are moved in the charge transfer layer 15 and are neutralized with the negative charges which have been trapped in the interface between the layers 13 and 16. During this step, if the primary charging in the negative polarity is larger than the secondary charging in the positive polarity, a certain amount of the negative charges remain in the interface as illustrated in FIG. 10E. Therefore, the potential in the bright portion $L_1$ becomes opposite to that in the dark portion $D_1$ to form an electrostatic latent image consisting of both positive and negative charges. Potentials $V_{L1}$ and $V_{D1}$ in the imagewise bright and dark portions $L_1$ and $D_1$, respectively may be expressed as follows, $$\begin{cases} V_{L1} = V_1 + \dfrac{C_p}{C_i + C_p} \cdot V_2 \\ V_{D1} = \dfrac{C_p}{C_i + C_p} \cdot V_1 + V_2 \end{cases}$$

wherein $V_2$ is a potential of the secondary charging. Therefore, the electrostatic contrast $V_c$ of the latent image may be represented by the following equation.

$$V_c = \frac{C_i}{C_i + C_p} \cdot |V_1 - V_2|$$

For instance, it is assumed that $V_1 = -400$ volts, $V_2 = 600$ volts and $$\frac{C_p}{C_i + C_p} = \frac{C_i}{C_i + C_p} = \tfrac{1}{2},$$

$|V_1 - V_2| = 1{,}000$ volts, $V_{L1} = -100$ volts and $V_{D1} = 400$ volts are obtained and therefore, the contrast $V_c$ becomes equal to 500 volts. In this manner, according to the invention, it is possible to form a latent image having a very high contrast. In a known electrophotographic process, in order to obtain the same contrast of $V_c = 500$ volts, $V_L = 500$ volts, $$\frac{C_i}{C_i + C_p} V = 0.5V$$

and thus, the charging potential V might be increased to $V = 1{,}000$ volts, whereas if the potential V is made equal to 600 volts, a relatively low contrast $V_c = 0.5 \times 600 = 300$ volts can only be obtained.

Figure 10H:
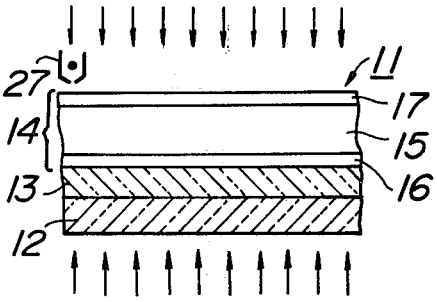

After the latent image has been formed as explained above, the latent image is developed with negatively charged toners 23 to form a toner image which is then transferred onto a record paper 25 by means of a transfer roller 24 as illustrated in FIG. 10F. Then the toner image transferred onto the record paper 25 is fixed thereon by means of a heater 26 as shown in FIG. 10G. By repeating the developing, transferring and fixing for the same and single latent image once formed in the photosensitive member 11, it is possible to obtain a plurality of copies. After forming the desired number of copies, the latent image is erased by uniformly exposing the member 11 from both sides and simultaneously effecting an A.C. corona charging from the side of the photoconductive layer 14 by means of an A.C. corona charger 27 as depicted in FIG. 10H. In this manner, the photosensitive member 11 can be prepared for the next duplicating operation. The latent image may be erased by connecting the photoconductive layer 14 to the earth by means of a conductive brush, while the photoconductive layer 14 is irradiated from both sides.

As explained above, in the electrophotographic process according to the invention, in the steps shown in FIGS. 10C and 10E, photo-carriers are not produced in the imagewise dark portions $D_2$ and $D_1$, respectively. Therefore, during the step of FIG. 10C, positive photo-carriers among photo-carrier pairs produced in the first charge generation layer 16 at the imagewise bright portion $L_2$ are moved along an electric field toward the second charge generation layer 17 perpendicularly and are neutralized with the negative charges on the layer 17, and negative photo-carriers are effectively retained in the interface between the layers 13 and 16 along an electric field. Further, in the step illustrated in FIG. 10E, negative photo-carriers among photo-carrier pairs generated in the layer 17 at the bright portion $L_1$ are neutralized with the positive charges on the layer 17, and positive photo-carriers are moved toward the insulating layer 13 perpendicularly under the influence of an electric field. Therefore, in both steps, photo-carriers are not spread laterally and thus, the resolution of the latent image is high. Further, the electrostatic contrast of the image is also high as explained above in detail.

In the above embodiment, the charge transfer layer 15 is made of P-type material and the primary charging is effected in the negative polarity. In a modified embodiment, the primary charging may be effected in the positive polarity, while the charge transfer layer 15 is made of the same P-type material. In this case, the primary and secondary imagewise exposures shown in FIGS. 10A and 10C are effected from the side of the photoconductive layer 14 and the secondary and primary imagewise exposures illustrated in FIGS. 10D and 10E are carried out from the side of the transparent conductive substrate 12.

In another modified embodiment, the charge transfer layer 15 is made of N-type material and the primary charging is effected in the negative polarity. Then the primary and secondary imagewise exposures shown in FIGS. 10A and 10C are conducted from the side of the photoconductive layer 14 and the secondary and primary imagewise exposures illustrated in FIGS. 10D and 10E are effected from the side of the substrate 12.

In still another modified embodiment, the charge transfer layer 15 is made of N-type material and the primary charging is effected in the positive polarity. Then, the imagewise exposures shown in FIGS. 10A and 10C take place from the side of the transparent substrate 12 and the imagewise exposures depicted in FIGS. 10D and 10E are carried out from the side of the photoconductive layer 14.

In either modified embodiment, an electrostatic charge image having a higher contrast can be formed by charges trapped across the insulating layer 13, and thus a number of copies having excellent image quality can be obtained from single latent image by repeating the developing, transferring and fixing steps successively.

In the embodiments of the electrophotographic process shown in FIGS. 8A to 8H and 10A to 10H, a negative image is projected onto the photosensitive member during the secondary imagewise exposing step. This negative image may be obtained with the aid of the photochromic member such as $SrTiO_3$:Ni-Mo as explained in the example 1. That is to say, at first the photochromic member is irradiated with a positive document image by means of ultraviolet rays and an irradiated portion of the photochromic member is colored to form a negative image. Then, the photochromic member is placed on a document table.

The photochromic member may be made of other inorganic or organic substances. As inorganic materials, use may be made of $SrTiO_3$:Fe-Mo, $CaF_2$:Sm-Eu, silver halide glass, alkali halide having F-center, and a mixed crystal of mercurous iodide-silver iodide, and as organic substances, use may be made of spiro-pyranes, hexaphenyl biimidazolyl, tetrachloro-α-diketo-dihydronaphthaline, p-dimethylaminoazobenzene and anils. Since the photochromism utilizes a molecular chemical change, it is possible to attain an extremely high resolution of more than 2,000 lines/mm, and the image can be easily erased by heating the photochromic member to a suitable temperature.

Further, a negative image may be obtained with the aid of a liquid crystal or an electronic image processing device.

Figure 11:
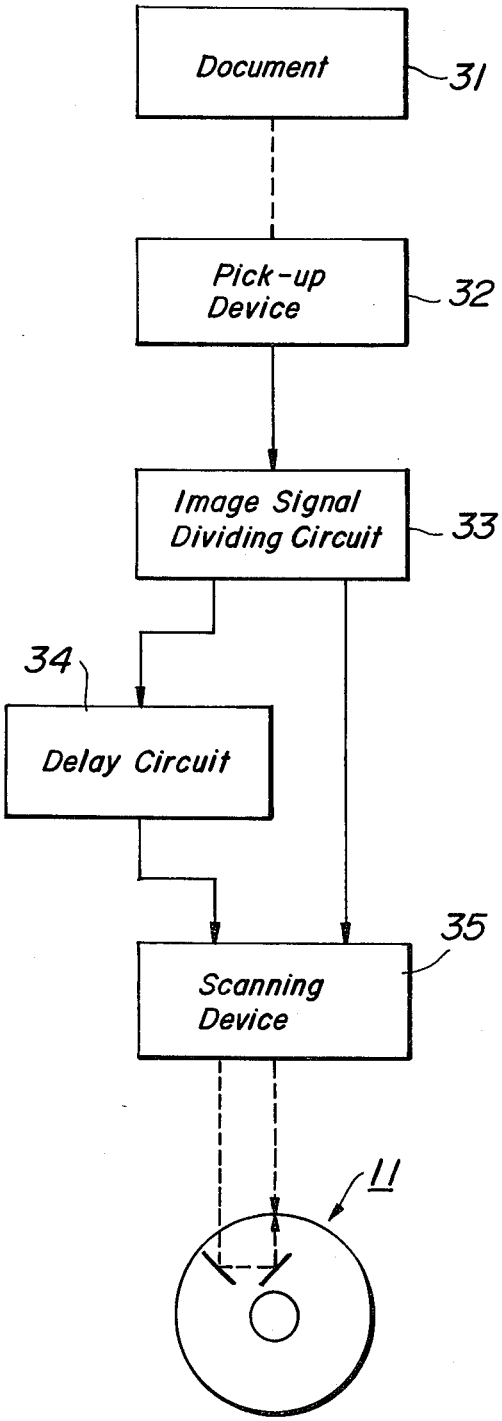
FIG. 11 is a block diagram illustrating an electronic image processing device for producing positive and negative images of a document to be duplicated.

FIG. 11 is a schematic view showing an embodiment of an electronic image processing device which can produce positive and negative of a document to be duplicated. A document 31 is scanned by a pick-up device 32 to derive an image signal serially. The image signal thus obtained is supplied to an image signal dividing circuit 33, directly or via a computer or facsimile transmission path, and positive and negative image signals are derived. These image signals are supplied to a scanning device 35 directly and via a delay circuit 34 and a light source such as a laser light source provided in the scanning device 35 is modulated in accordance with the positive and negative image signals at suitable timings. In this manner, the positive and negative images can be projected onto the photosensitive member 11. If the image projection system shown in FIG. 11 is used in the embodiment shown in FIGS. 10A to 10H, the positive and negative image signals may be supplied to the scanning device 35 by means of a plurality of delay circuits.

As explained above in detail, in the electrophotograhic process according to the invention since use is made of a photosensitive member comprising a photoconductive layer which has a charge generation function at least in both surface regions and the photosensitive member is irradiated from both surfaces, the photoconductive layer can be made of any kinds of material which is readily available by suitably utilizing a combination of the polarity of charging and the side of the photosensitive member from which the exposing is effected. Further, since the charge transfer function of the photoconductive layer can be effectively utilized, it is possible to form an electrostatic latent image having extremely high contrast and resolution and to retain the latent image in stable form for a very long time. Therefore, a number of copies having excellent image quality can be formed from a single latent image. Particularly, when using the photosensitive member shown in FIG. 3 in which the insulating layer is sandwiched between the substrate and photoconductive layer, the latent image is formed inside the photosensitive member and thus, the latent image is not substantially affected by the developing and transferring steps. Moreover, since the latent image can be erased fully within a short time, the photosensitive member is not substantially deteriorated for a long time and the latent image is not substantially affected by residual latent image. Particularly, in the embodiment shown in FIGS. 8A to 8H, since the photosensitive member is uniformly irradiated over its entire surface, the photosensitive member is not substantially locally fatigued or deteriorated and thus it be used over and over again.

It should be noted that the present invention is not limited to the embodiments explained above, but may be modified in various ways within the scope of the invention. For instance, the photosensitive member shown in FIGS. 4, 5, 6 and 7 may also be used in the embodiments shown in FIGS. 8A to 8H, 9A to 9H and 10A to 10H.

What is claimed is:

1. An electrophotographic process for forming at least one copy of a document by means of an electrophotographic photosensitive member which comprises a transparent conductive substrate, a transparent insulating layer applied on the substrate and a photoconductive layer applied on the insulating layer and having surface charge generation layers and a charge transfer layer for transferring freely carriers of a predetermined polarity between the charge generation layers, comprising the steps of:

(a) effecting a primary charge for charging the photosensitive member in one polarity and a primary image exposure for exposing the photosensitive member to a positive image of a document from one side of the photosensitive member;

(b) effecting a secondary image exposure for exposing the photosensitive member to a negative image of the document from said one side of the photosensitive member;

(c) effecting a secondary charge for charging the photosensitive member in the other polarity and a tertiary image exposure for exposing the photosensitive member to the negative image of the document from the other side of the photosensitive member; and (d) effecting a light exposure for exposing at least imagewise bright portion of the photosensitive member corresponding to a bright portion of the positive image of the document from the other side of the photosensitive member;

whereby photocarriers of said predetermined polarity of the charge transfer layer among photocarrier pairs generated in the surface charge generation layers are moved effectively through the bulk of said photoconductive layer so as to form an electrostatic latent image by charges trapped across the transparent insulating layer.

2. A process according to claim 1, wherein said primary charge and primary image exposure of step (a) are effected simultaneously.

3. A process according to claim 1, wherein said primary charge and primary image exposure of step (a) are effected successively.

4. A process according to any one of claims 2 and 3, wherein said primary charge of step (a) is effected in a polarity identical with said predetermined polarity of the charge transfer layer, said primary image exposure of step (a) is effected from the side of the photoconductive layer, said secondary image exposure of step (b) is carried out from the side of the photoconductive layer, and said tertiary image exposure of step (c) is effected from the side of the transparent substrate.

5. A process according to claim 4, wherein said light exposure of step (d) is effected by exposing the photosensitive member to the positive image of the document from the side of the transparent substrate.

6. A process according to claim 4, wherein said light exposure of step (d) is effected by uniformly exposing the photosensitive member from the side of the transparent substrate.

7. A process according to any one of claims 2 and 3, wherein said primary charge of step (a) is effected in a polarity opposite to said predetermined polarity of the charge transfer layer, said primary image exposure of step (a) is effected from the side of the transparent substrate, said secondary image exposure of step (b) is carried out from the side of the transparent substrate, and said tertiary image exposure of step (c) is effected from the side of the photoconductive layer.

8. A process according to claim 7, wherein said light exposure of step (d) is effected by exposing the photosensitive member to the positive image of the document from the side of the photoconductive layer.

9. A process according to claim 7, wherein said light exposure of step (d) is effected by uniformly exposing the photosensitive member from the side of the photoconductive layer.

10. A process according to claim 1, further comprising:

erasing the electrostatic latent image by projecting uniform light from both sides of the photosensitive member.

11. A process according to claim 10, wherein during the erasing step, the photosensitive member is subjected to an A.C. corona charge.

12. A process according to claim 10, wherein during the erasing step, the photoconductive layer is brought into contact with a conductive brush having a given potential.

13. An electrophotographic process for forming at least one copy of a document by means of an electrophotographic photosensitive member which comprises a transparent conductive substrate, a transparent insulating layer applied on the substrate and a photoconductive layer applied on the insulating layer and having surface charge generating layers and a charge transfer layer for transferring freely carriers of a predetermined polarity between the charge generation layers, comprising the steps of:

(a) effecting a primary charge for charging the photosensitive member in one polarity and a light exposure for exposing uniformly the photosensitive member from one side thereof;

(b) effecting simultaneously a secondary charge for charging the photosensitive member in the other polarity and an image exposure for exposing the photosensitive member to a positive image of a document from the other side thereof; and (c) effecting a light exposure for exposing at least an imagewise dark portion of the photosensitive member corresponding to a dark portion of the positive image of the document from the other side thereof;

whereby photocarriers of said predetermined polarity of the charge transfer layer among photocarrier pairs generated in the surface charge generation layers are moved effectively through the bulk of said photoconductive layer so as to form an electrostatic latent image by charges trapped across the transparent insulating layer.

14. A process according to claim 13, wherein said primary charge and uniform exposure of step (a) are effected simultaneously.

15. A process according to claim 13, wherein said primary charge and uniform exposure of step (a) are effected successively.

16. A process according to any one of claims 14 and 15, wherein said primary charge of step (a) is effected in a polarity identical with said predetermined polarity of the charge transfer layer, said uniform exposure of step (a) is carried out from the side of the photoconductive layer, and said image exposure of step (b) is effected from the side of the transparent substrate.

17. A process according to claim 16, wherein said light exposure of step (c) is effected by uniformly exposing the photosensitive member from the side of the transparent substrate.

18. A process according to claim 16, wherein said light exposure of step (c) is effected by exposing the photosensitive member to a negative image of the document from the side of the transparent substrate.

19. A process according to any one of claims 14 and 15, wherein said primary charge of step (a) is effected in a polarity opposite to said predetermined polarity of the charge transfer layer said uniform exposure of step (a) is carried out from the side of the transparent substrate, and said image exposure of step (b) is effected from the side of the photoconductive layer.

20. A process according to claim 19, wherein said light exposure of step (c) is effected by uniformly exposing the photosensitive member from the side of the photoconductive layer.

21. A process according to claim 19, wherein said light exposure of step (c) is carried out by exposing the photosensitive member to a negative image of the document from the side of the photoconductive layer.

22. A process according claim 13, further comprising:

erasing the electrostatic latent image by projecting uniform light onto both sides of the photosensitive member.

23. A process according to claim 22, wherein during the erasing step, the photosensitive member is subjected to an A.C. corona charge.

24. A process according to claim 22, wherein during the erasing step, the photoconductive layer is brought into contact with a conductive brush having a given potential.

* * * * *